US008250834B2

(12) United States Patent
Wild et al.

(10) Patent No.: US 8,250,834 B2
(45) **Date of Patent: *Aug. 28, 2012**

(54) APPARATUS FOR APPLYING DRINKING STRAWS

(75) Inventors: Hans Peter Wild, Zug (CH); Eberhard Kraft, Neckarbischofsheim (DE)

(73) Assignee: INDAG Gesellschaft für Industriebedarf mbH & Co. Betriebs KG, Eppelheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/911,426

(22) Filed: Oct. 25, 2010

(65) Prior Publication Data

US 2011/0036053 A1 Feb. 17, 2011

Related U.S. Application Data

(63) Continuation of application No. 09/690,409, filed on Oct. 17, 2000, now Pat. No. 7,946,098.

(30) Foreign Application Priority Data

Oct. 28, 1999 (DE) ..... 199 52 008

(51) Int. Cl.
*B65B 61/20* (2006.01)

(52) U.S. Cl. ..... 53/133.1; 53/410; 156/358

(58) Field of Classification Search ..... 53/133.1, 53/133.2, 410, 443; 156/358

See application file for complete search history.

(56) References Cited

U.S. PATENT DOCUMENTS

| | | | | | |
|---|---|---|---|---|---|
| 4,384,915 | A * | 5/1983 | Utsumi | ..... | 156/499 |
| 4,572,758 | A * | 2/1986 | Wild | ..... | 156/256 |
| 4,574,558 | A * | 3/1986 | Utsumi | ..... | 53/136.1 |
| 4,584,046 | A * | 4/1986 | Geyssel | ..... | 156/358 |
| 4,584,819 | A * | 4/1986 | Hakansson | ..... | 53/410 |
| 4,669,699 | A * | 6/1987 | Kaneko | ..... | 248/652 |
| 4,707,965 | A * | 11/1987 | Becker | ..... | 53/410 |
| 5,979,142 | A * | 11/1999 | Kraft et al. | ..... | 53/410 |
| 6,681,547 | B1 * | 1/2004 | Wild et al. | ..... | 53/410 |

* cited by examiner

*Primary Examiner* — Thanh Truong

(74) *Attorney, Agent, or Firm* — Stroock & Stroock & Lavan LLP

(57) ABSTRACT

Described is an apparatus for applying a drinking straw on a receiving surface of a stand up bag which can be supplied on a conveying surface to a transfer device for drinking straws. To increase the conveying speed of said apparatus, the transfer means should be arranged such the drinking straw while being handed over encloses an acute angle with the conveying surface.

6 Claims, 2 Drawing Sheets

APPARATUS FOR APPLYING DRINKING STRAWS

Figure 1:
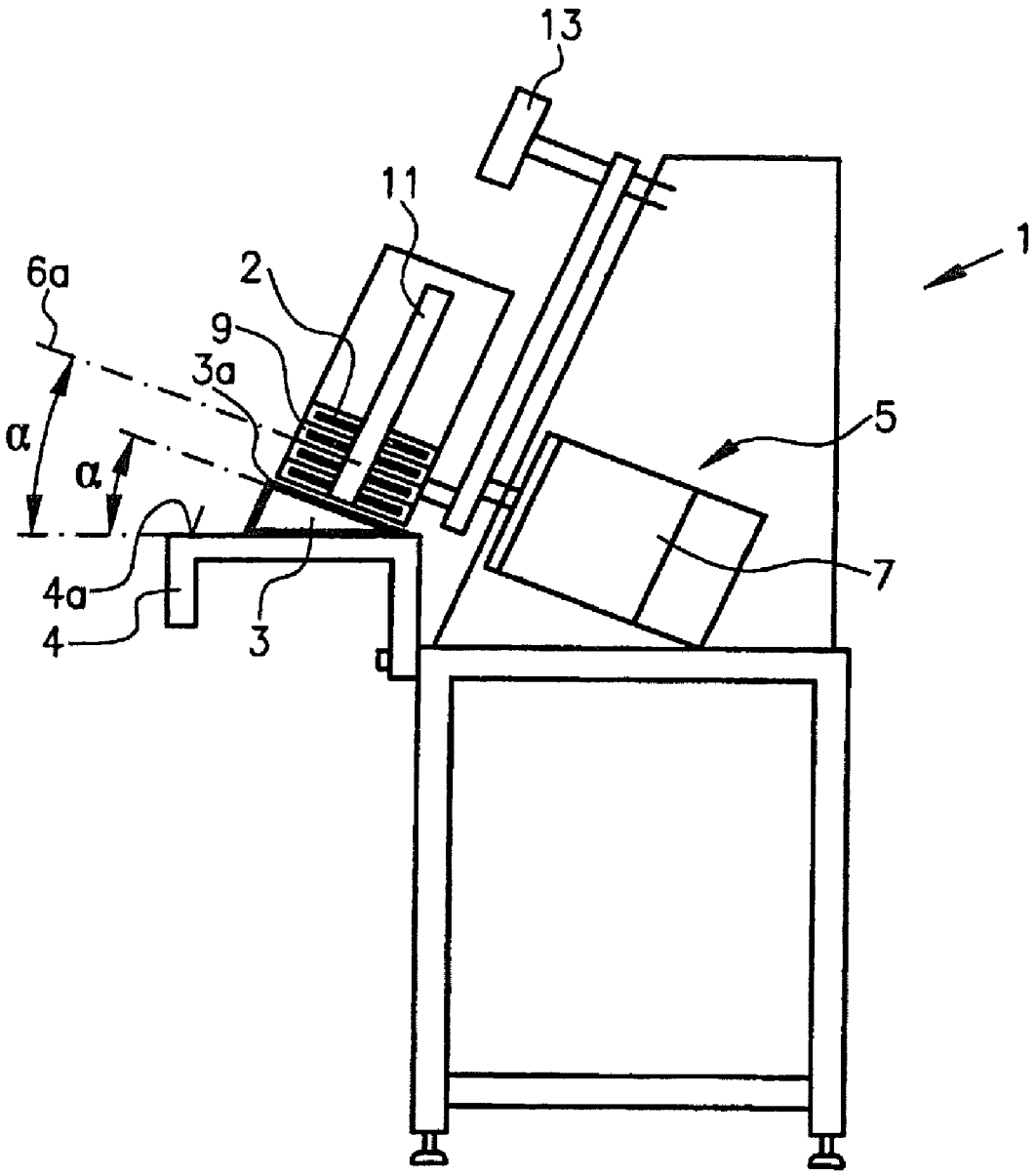

The present invention relates to an apparatus for applying drinking straws of the type explained in the preamble of claim 1.

Such an apparatus is known from DE 197 45 855. The known apparatus uses a transfer device in the form of a rotary drum on the periphery of which a drinking straw strip is supplied that consists of still cohering packages of individually packed drinking straws. Furthermore, the drinking straw strip contains adhesive points already applied before, which are covered with a cover strip for the time being. Shortly before being applied to the stand up bag the cover strip is removed from the adhesive points and the drinking straw packages are isolated, preferably cut, so that a respective drinking straw can then be adhesively applied by the roller, supported by a press-on finger, to each bag. The known apparatus is designed for applying drinking straws to stand up bags conveyed in an upright manner on a conveyor belt, the transfer means enclosing a right angle with the conveyor surface.

EP 149 076 B1 describes a further apparatus for applying drinking straws which is designed for applying drinking straws to lying bags. The transfer device for the drinking straws extends here in parallel with the conveying surface on which the bags are located.

Stand up bags, however, have no parallel side surfaces but consist of two rectangular film pieces which are secured along their longitudinal edges one on top of the other and which in the area of their lower transverse edges have an inserted or molded-on stand up bag and in the area of their upper transverse edges are indirectly welded one on top of the other, resulting in a substantially triangular longitudinal section. Both in the case of an upright transportation and a lying transportation the attachment surfaces on the bag are thus not in parallel with the conveying surface and thus also not in parallel with the transfer device for the drinking straws. Normally, this is not objectionable, as becomes also apparent from the well-functioning devices of the prior art.

The invention, however, has found out that the handling speeds in said vertical or parallel arrangement of the transfer device relative to the conveying surface can still be optimized.

It is thus the object of the present invention to improve an apparatus for applying drinking straws to stand up bags in such a manner that their conveying speed is increased.

Said object is achieved by the features indicated in claim 1.

Thanks to the design according to the invention the movement path of the drinking straws can be shortened and the drinking straws can be moved in a parallel movement without any angular change from the transfer device to the bag. Although the increase in speed achieved thereby is within the range of fractions of seconds, even such a small increase in speed effects an economic result in a mass product such as a stand up bag and with the high throughputs achieved by modem bag filling and packaging systems.

Advantageous developments of the invention can be gathered from the sub-claims.

Figure 2:
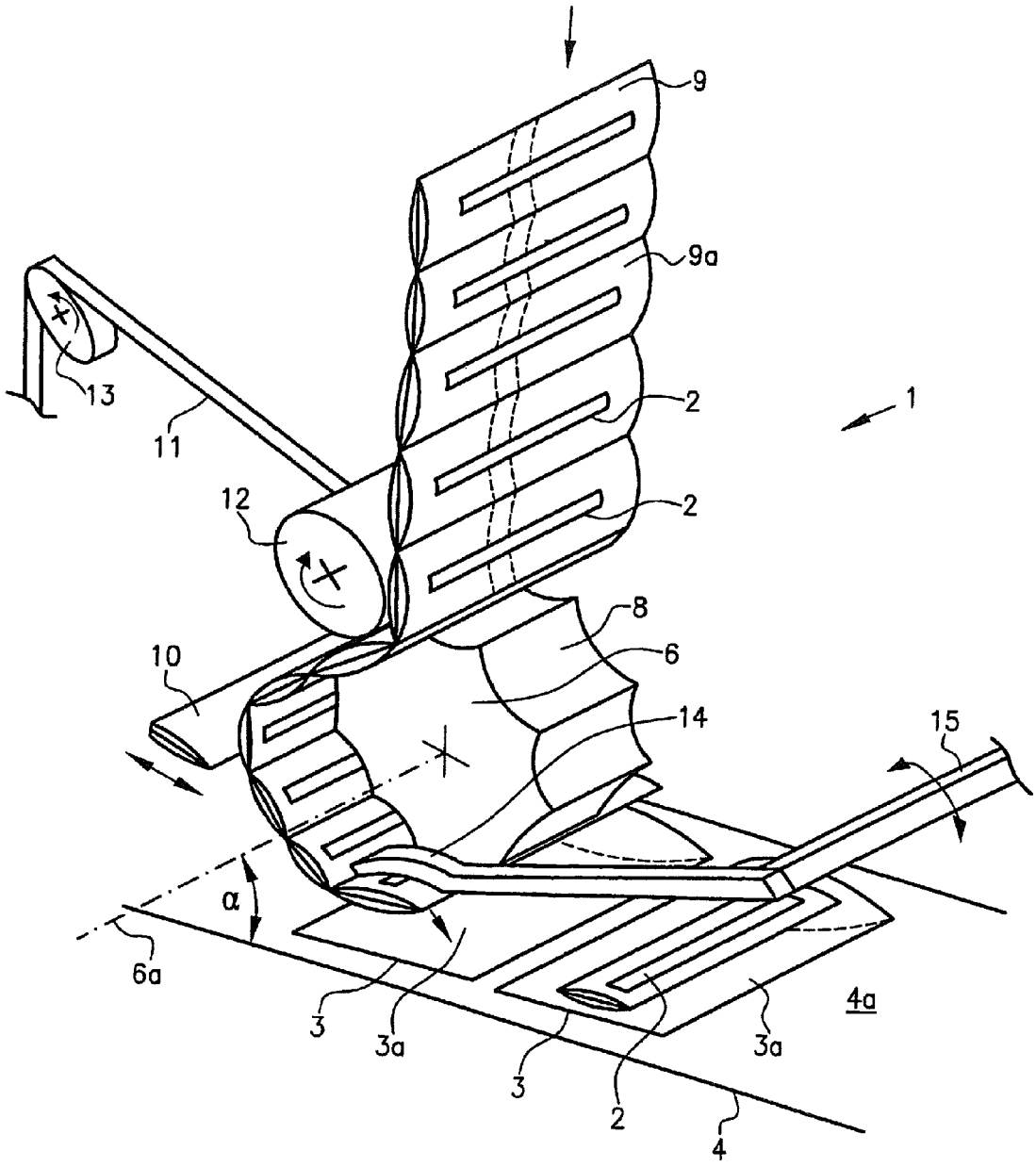

An embodiment of the present invention shall now be explained with reference to the drawings, in which:

FIG. 1 is a schematic side view of an apparatus according to the invention; and FIG. 2 is a schematic view showing details of the apparatus according to FIG. 1.

FIGS. 1 and 2 shows an apparatus 1 for applying drinking straws 2 to a receiving surface 3*a* of stand up bags 3. The stand up bags are transported in a lying position on a horizontal conveyor belt 4 in a direction perpendicular to the illustration in FIG. 1, the upper side of the horizontal conveyor 4 forming a substantially horizontal conveyor surface 4*a*.

The apparatus 1 contains a transfer means 5 which comprises a transfer drum 6 which is rotations driven by a motor 7 about a rotational axis 6*a*. The transfer drum 6 is provided on its periphery with recesses 8 which can each receive one of the drinking straws 2. The drinking straws 2 are individually sealed in packages 9*a* which before reaching a cutting device 10 are still cohering in a continuous drinking straw strip 9. The packages 9*a* are already provided with adhesive points which are protectively covered by a cover strip 11. The drinking straw strip 9 is supplied by supply devices (not shown), it is pressed by a press-on roll 12 against the transfer drum 6 while the cover strip 11 is removed via a roll 13 which is driven in synchronism with the transfer drum 6 by the motor 7. The transfer drum 6 has assigned thereto a transfer finger 14 which is movable around a pivot arm 15 in the direction of the double-headed arrow and presses the packages 9*a*, which have been isolated by the cutting device 10, together with the drinking straw 2 onto the receiving surface 3*a* of the bags which have been supplied in a lying position on the conveyor 4, whereby the adhesive points can adhere.

The rotational axis 6*a* of the transfer drum 6 is inclined by an angle $\alpha$ relative to the conveying surface 4*a*. The angle a is smaller than 90° and preferably corresponds to the angle $\alpha$ under which the receiving surface 3*a* is inclined relative to the conveying surface 4*a* when the stand up bag 3 is transported in a lying position on the conveying surface 4*a*. Furthermore, said angle a corresponds to the angle enclosed by the receiving surface with the opposite surface of the bag 3 which rests on the conveying surface 4*a*. Since stand up bags which are filled with beverages cannot exactly keep their shape because most of the time they consist of plastic films or laminated aluminum foils, angle $\alpha$ can also be determined as a mean value.

During operation the stand up bags 3 are supplied in a continuous row on the conveyor 4 to the transfer device 5, the transfer drum 6 is rotated in synchronism with the conveyor speed of the conveyor 4 about the axis 6*a*, the drinking straw strip 9 is fed continuously, the cover strip 11 is continuously removed, the individual packages 9*a* are cyclically isolated by the cutting device from the drinking straw strip 9 and cyclically pressed by the press-on finger 14 onto the receiving surface 3*a* of the stand up bags. For retaining the already isolated drinking straw packages 9*a* the transfer drum 6 can be designed as a suction drum. Two adjacent transfer drums can also be used that have a distance from each other which enables the finger 14 to operate between the drums so that an even better support of the isolated drinking straw packages 9 is achieved.

On account of the inclined position of the rotational axis 6*a* relative to the conveyor surface 4*a*, the drinking straw package 9*a* impinges on said receiving surface 3*a* exactly in parallel with said surface 3*a*, i.e. it need not carry out a displacing and tilting movement as has so far been necessary. The conveying movement can thereby be further accelerated.

In a modification of the described and illustrated embodiment, the apparatus according to the invention can also be used for applying drinking straws to stand up bags conveyed in an upright position; in this case, however, the angle of inclination must be adjusted to the larger acute angle which is enclosed by the receiving surface relative to the conveying surface and which is approximately 90° minus half the angle of enclosure between the receiving surface and the opposite surface on the stand up bag.

In a further modification of the described and illustrated embodiment, it is also possible to use other transfer means which are capable of applying drinking straws very rapidly. Furthermore, it is not absolutely necessary that all of the components of the devices are inclined. It is enough when the drinking straw has such an angle while being handed over.

The invention claimed is:

1. An apparatus for applying straw packages onto a plurality of bags, each bag having a first side wall, comprising a first rectangular film piece, connected to a second side wall, comprising a second rectangular film piece, along three edges thereof and a base connected to a bottom edge of the first side wall and to a bottom edge of the second side wall such that each bag has a vertical triangular cross section between the first side wall and second side wall, the apparatus comprising:

a conveyor belt constructed and arranged to convey the plurality of bags, each bag lying substantially on its side at a position on the conveyor belt such that the first side wall contacts the conveyor belt and the second side wall is at an acute angle with the conveyor belt;

a straw package supply assembly for supplying a plurality of straw packages having an adhesive thereon;

a transfer assembly positioned above the conveyor belt, the transfer assembly constructed and arranged to receive a plurality of straw packages from the straw package supply assembly, the transfer assembly having a straw retaining member constructed and arranged to retain the straw packages at an acute angle to the conveyor belt such that the adhesive substantially faces the conveyor belt, wherein the straw retaining member comprises two adjacent transfer drums and at least one of the transfer drums is a suction drum and the adjacent transfer drums are designed and configured such that one of the transfer drums presses the straw packages against the other transfer drum when the straw packages are received, the transfer assembly also including a straw applying member having a depressing arm and a pivoting arm, wherein rotating the pivoting arm of the lever displaces the depressing arm in a downward direction to the position of the conveyor belt at the position of each bag to apply a downward force substantially perpendicular to the conveyor to displace a straw package away from the retaining member to apply the straw package onto the second side wall of one of the plurality of bags when the bag is positioned on the conveyor belt in a substantially lying position.

2. The apparatus of claim 1 wherein the transfer assembly is positioned directly above the conveyor belt.

3. The apparatus of claim 1 wherein a cover strip covers the adhesive on at least one of the plurality of straw packages and further comprising a roll for removing the cover strip from at least one of the plurality of straw packages to expose the adhesive.

4. The apparatus of claim 1 wherein the straw retaining member is rotatable about an axis substantially parallel to the second side wall of a bag being conveyed on the conveyor belt.

5. The apparatus of claim 1 wherein the transfer assembly is capable of applying at least one of the plurality of straw packages to each bag such that the adhesive of the straw package contacts the second side wall of the bag while maintaining the straw package substantially parallel to the second side wall of the bag.

6. The apparatus of claim 1 further comprising a disconnecting member constructed and arranged to disconnect at least one straw package from the plurality of straw packages.

* * * * *